US005634606A

United States Patent [19]

Röder

[11] Patent Number: 5,634,606

[45] Date of Patent: Jun. 3, 1997

[54] PRESS-ON ROLLER

[75] Inventor: Klaus W. Röder, Würzburg, Germany

[73] Assignee: Koenig & Bauer-Albert Aktiengesellschaft, Wurzburg, Germany

[21] Appl. No.: 523,128

[22] Filed: Sep. 5, 1995

[30] Foreign Application Priority Data

Sep. 6, 1994 [DE] Germany ..... 44 31 648.8

[51] Int. Cl.[6] ..... B65H 19/18

[52] U.S. Cl. ..... 242/555.3; 492/4; 492/29

[58] Field of Search ..... 242/555.3, 555.4, 242/555.6, 556, 556.1, 542.4, 547, 571.1, 615.2, 615.4, 610.6, 610.1; 492/4, 29, 36, 56

[56] References Cited

U.S. PATENT DOCUMENTS

| | | | |
|---|---|---|---|
| 3,235,906 | 2/1966 | Conti | 492/4 |
| 3,493,161 | 2/1970 | Billings et al. | 242/610.6 |
| 3,543,366 | 12/1970 | Collet | 492/4 |
| 3,618,869 | 11/1971 | Cialone et al. | 242/542.4 |
| 3,667,584 | 6/1972 | Karlsson | 492/36 |
| 3,706,119 | 12/1972 | Collet . | |
| 3,768,746 | 10/1973 | Crone . | |
| 3,812,561 | 5/1974 | Lundgren | 492/36 |
| 3,917,185 | 11/1975 | Canada et al. | 242/610.6 |
| 3,972,488 | 8/1976 | Lee et al. | 242/571.2 |
| 4,327,467 | 5/1982 | Quaint . | |
| 4,425,695 | 1/1984 | Tokuno | 492/4 |
| 4,455,727 | 6/1984 | Tschirner | 492/4 |
| 4,541,585 | 9/1985 | Frye et al. | 242/542.4 |
| 5,335,871 | 8/1994 | Fissmann et al. | 242/542.4 |
| 5,354,006 | 10/1994 | Roder | 242/555.3 |
| 5,385,316 | 1/1995 | Weis | 242/556.1 |
| 5,431,358 | 7/1995 | Alexander | 242/542.4 |

FOREIGN PATENT DOCUMENTS

| | | |
|---|---|---|
| 1940175 | 2/1971 | Germany . |
| 2331125 | 8/1974 | Germany . |
| 4135101 | 4/1993 | Germany . |
| 388699 | 6/1965 | Switzerland . |
| 1149299 | 4/1969 | United Kingdom . |

*Primary Examiner*—John M. Jillions

*Attorney, Agent, or Firm*—Jones, Tullar & Cooper, P.C.

[57] ABSTRACT

A press-on roller which is usable to press a first paper web into contact with a second paper web includes a support tube and a resilient press-on sleeve which is concentric with the support tube and separated from it by an annular space. This annular space is provided with at least one and preferably with a plurality of gas-filled cells. These gas filled cells provide the press-on roller with a controllable resiliency.

19 Claims, 3 Drawing Sheets

PRESS-ON ROLLER

FIELD OF THE INVENTION

The present invention is directed generally to a press-on roller. More particularly, the present invention is directed to a press-on roller for pressing a moving web into contact with a leading end of a fresh web on a web supply reel. Most specifically, the present invention is directed to a press-on roller having an annular, gas-filled chamber. The press-on roller utilizes a central support tube and an outer press-on shell. The support tube and the press-on shell are separated by an annular space. This annular space is filled with one or more gas cells. These gas cells provide the support for the outer shell in a manner which allows the outer shell to adapt to uneven surfaces of a rotating supply reel that carries the second web. The gas pressure in the cell or cells in the annular space can be adjusted to vary or control the firmness or resiliency of the press-on roller.

DESCRIPTION OF THE PRIOR ART

In the field of web-fed printing presses, it is generally well known to make a flying web change. This is a procedure in which the leading end of a fresh roll of a paper web is attached to a depleting web from a used web supply roll while both the fresh roll and the used web supply roll are traveling at normal press operating speeds. Such a flying web splice is typically accomplished by providing the leading end of the fresh web with a suitable adhesive splice tape and by moving the depleting web into contact with the adhesively prepared leading end of the fresh web once the fresh supply roll has been brought up to the correct rotational speed. A press-on roller is typically utilized to move the depleting web into contact with the leading end of the fresh web.

One prior art press-on roller is shown in German patent application DE 23 31 125. This prior art roller has a rubber layer on its periphery and consists of a two-walled tube that is rotatably supported between spaced supporting arms. During a flying web splice, this press-on roller is displaceable toward the fresh supply reel to accomplish the joining of the depleting web to the fresh web on the fresh supply reel.

One limitation of this generally known press-on roller is that the compressibility of the rubber outer layer or covering of the tube is somewhat limited. If the fresh paper web supply reel has an uneven surface, the limited compressibility of the rubber layer on the press-on roller may not be sufficient to adequately press the depleting web into contact with the prepared leading end of the fresh web. This results in a poorly executed web splice and may necessitate stoppage of the press due to a failure of the web.

It will be seen that a need exists for a pres-on roller which will adapt to uneven surfaces of a fresh web supply reel. The press-on roller in accordance with the present invention accomplishes this and is a significant improvement over the prior art.

SUMMARY OF THE INVENTION

It is an object of the present invention to provide a press-on roller.

Another object of the present invention is to provide a press-on roller usable in a flying web splice.

A further object of the present invention is to provide a press-on roller having a resilient surface.

Yet another object of the present invention is to provide a press-on roller that is lightweight.

Still a further object of the present invention is to provide a press-on roller whose surface resiliency is adjustable.

Even yet another object of the present invention is to provide a press-on roller which is adaptable to an uneven surface of a rotating paper web supply reel.

As will be discussed in greater detail in the description of the preferred embodiments' which is presented subsequently, the press-on roller in accordance with the present invention utilizes a generally rigid central support tube that carries a resilient or flexible press-on shell. The shell is spaced from the support tube by suitable end flanges or caps with there being provided an annular space between the outer surface of the tube and the inner surface of the shell. This annular space is provided with one or more inflatable gas cells. The pressure of the inflating medium, such as compressed air, supplied to these gas cells can be varied to thereby vary the surface resiliency of the press-on shell. This resiliency can be adjusted in accordance with the surface characteristics of the fresh paper web supply reel to insure that the press-on roller will fully engage the surface of the new supply reel during a paper web splice.

Since the press-on roller of the present invention has its annular space filled with one or a plurality of inflatable gas cells, the surface resiliency of the press-on roller can be quickly and effectively varied. If the surface contour of the fresh web supply reel is quite uneven, as would be the case if the new web had adhesive labels, the resiliency of the press-on roller can be increased by releasing some of the inflating medium from the gas-filled cells. If the surface of the fresh paper web supply reel is quite uniform, the inflation pressure in the gas-filled cell or cells can be increased. In accordance with one embodiment of the invention, the surface resiliency or compressibility of the press-on roller can be varied along the axial length of the roller. If the fresh paper web supply reel has different hardnesses or surface contour characteristics along its axial length, the resiliency or compressibility of the press-on roller can be adjusted along its length in a complimentary manner.

The press-on roller in accordance with the present invention has a low mass. This is an advantage since the rotational speed of the press-on roller may need to be changed quickly. With its low mass, the press-on roller of the present invention can be quickly and easily sped up or slowed down so that its rotational speed will match the linear web travel speed of the exhausting web which is to be pressed into contact with the new web by the press-on roller.

The press-on roller in accordance with the present invention overcomes the limitations of the prior art devices. It is a substantial advance in the art.

BRIEF DESCRIPTION OF THE DRAWINGS

While the novel features of the press-on roller in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
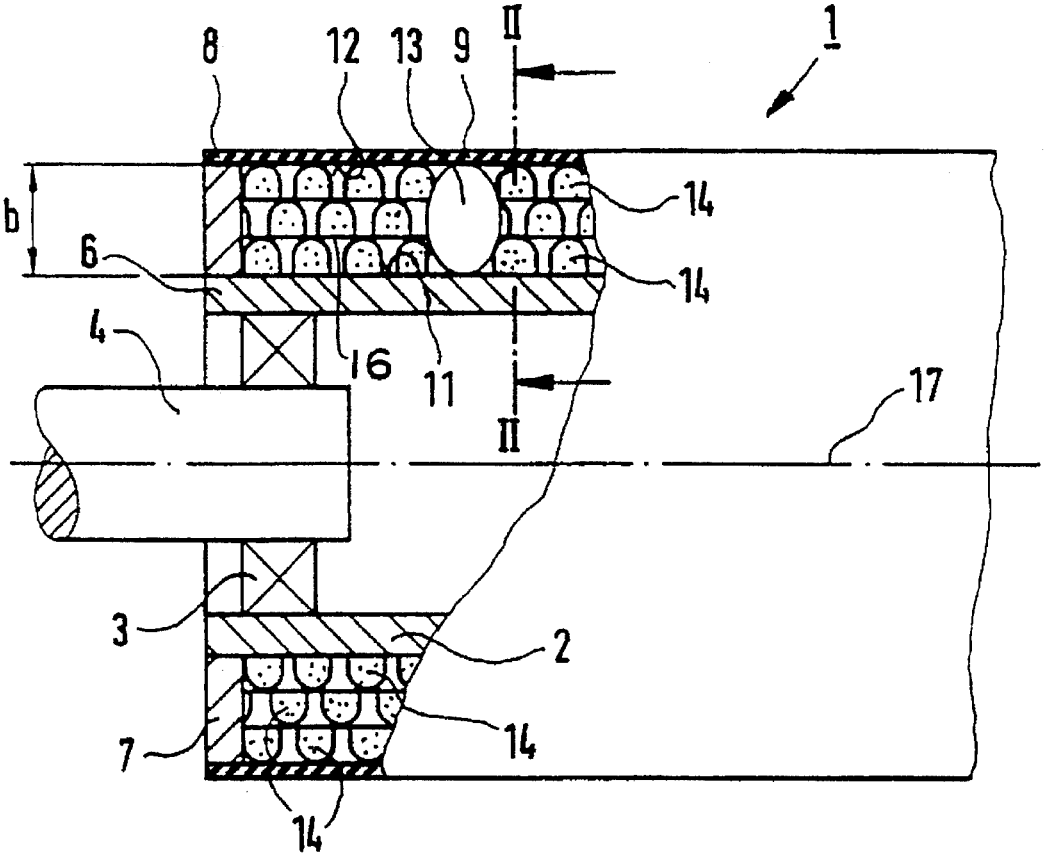
FIG. 1 is a side view, partially in cross-section of a first preferred embodiment of a press-on roller in accordance with the present invention.

Referring initially primarily to FIG. 1, there may be seen, generally at 1, a first preferred embodiment of a resilient press-on roller in accordance with the present invention. This press-on roller 1 is constructed having a central support tube 2, which is preferably made of metal, glass fiber or carbon fiber with suitable reinforcing materials. This central support tube 2 is a generally hollow, rigid tube. A suitable ball bearing assembly 3, which receives a support journal 4, is positioned within each end 6 of the support tube 2. This press-on tube 1 is rotatable about its support journals 4. It will be understood that both ends 6 of press-on roller 1 are the same and that only one such end is shown in the drawings. It will also be understood that press-on roller 1 will be supported by its journals 4 between suitable arms which are not specifically shown, and which will be used to move the press-on roller 1 into contact with a depleting paper web for the purpose of moving that depleting web into contact with a leading end of a fresh web on a paper web supply reel during a flying web splice. One typical arrangement of pivotable support arms or displaceable joining carriages in a press-on and separating device is shown in German patent application No. DE 41 35 101.

Figure 2:
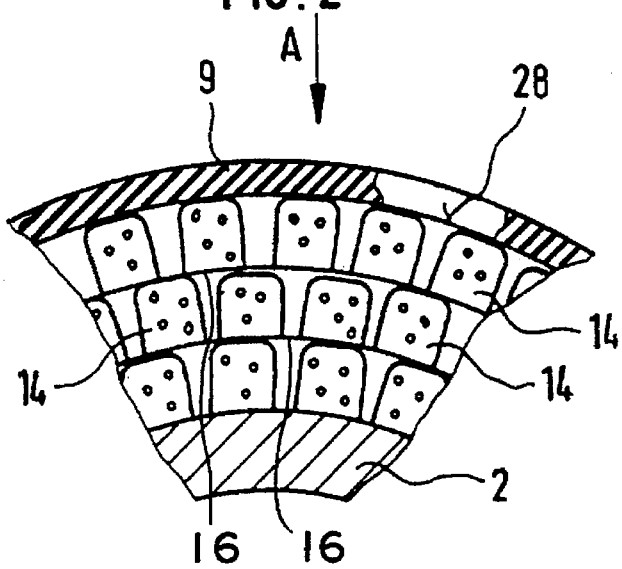
FIG. 2 is a cross-sectional end view of the press-on roller and taken along line II—II in FIG. 1.
Figure 3:
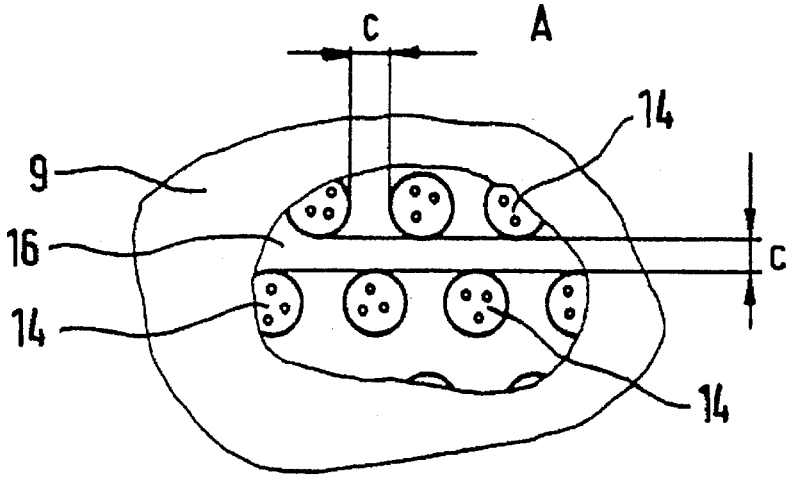
FIG. 3 is a top plan view of a portion of the press-on roller of FIG. 1.

Again referring to FIG. 1, each end 6 of the support tube 2 is provided with an annular end cover or end cap 7. An inner diameter of each end cap 7 is supported by an outer surface 11 of the support tubes 2. An outer diameter or circumference of each end cap 7 supports an end 8 of a generally elastic or resilient hollow press-on shell 9. The length of the active part of the press-on shell 9 corresponds to the width of the paper web which will be engaged by the press-on roller 1. This shell 9 has an inner surface 12 which is spaced from the outer surface 11 of the support tube 2. The generally annular space 13 which is defined by the outer surface 11 of the support tube 2, the inner surface 12 of the resilient press-on shell 9 and the two end caps 7 is filled with a large number of gas-filled cells 14, each of which is depicted in FIGS. 1, 2 and 3, but all of which are not numbered. All of these individual gas-filled cells 14 are attached to a suitable cell support foil or film generally at 16, as may be seen in FIGS. 1, 2 and 3. This flexible carrier material 16, which is provided with the individual gas-filled cells 14 can have a width which corresponds to the usable axial length of the press-on roller 1. The carrier material 16, with its attached gas-filled cells 14 can be wrapped around the support tube 2 in several layers in either a stacked or spirally wound manner with respect to the axis of rotation 17 of the press-on roller 1. The side edges of the carrier foil 16 will abut the inner faces of the two end caps 7. Thus the entire annular space 13 between the support tube 2 and the press-on shell 9 is filled with the air or gas-filled cells 14 and their carrier foil 16. The gas or air filled cells 14 can have any desired shape, such as a cylindrical shape. A commercially available air cushion foil can be used to provide the air filled cells 14 and their carrier foil 16.

The specific number of air-filled or gas-filled cells 14 will be a function of the volume of the annular space 13 and the size and placement density of the cells 14 on the carrier foil 16. The outer layer of cells 14 effectively forms an outer surface area 28 which could serve as the outer running surface of the press-on roller 1. For reasons of practicality, the outer press-on shell 9 is placed over the outer surface area 28 of the air or gas-filled cells 14 so that these cells 14 will not be ruptured or broken. The elastic press-on shell 9 thus forms the actual running surface of the press-on roller 1. In accordance with the present invention, all of the air or gas-filled cells 14 can be interconnected by tube-like connections so that the air or gas pressure in all of the cells 14 can be equalized. This will insure that the resiliency of the press-on roller 1 in accordance with the first preferred embodiment will be equal throughout its area.

Figure 4:
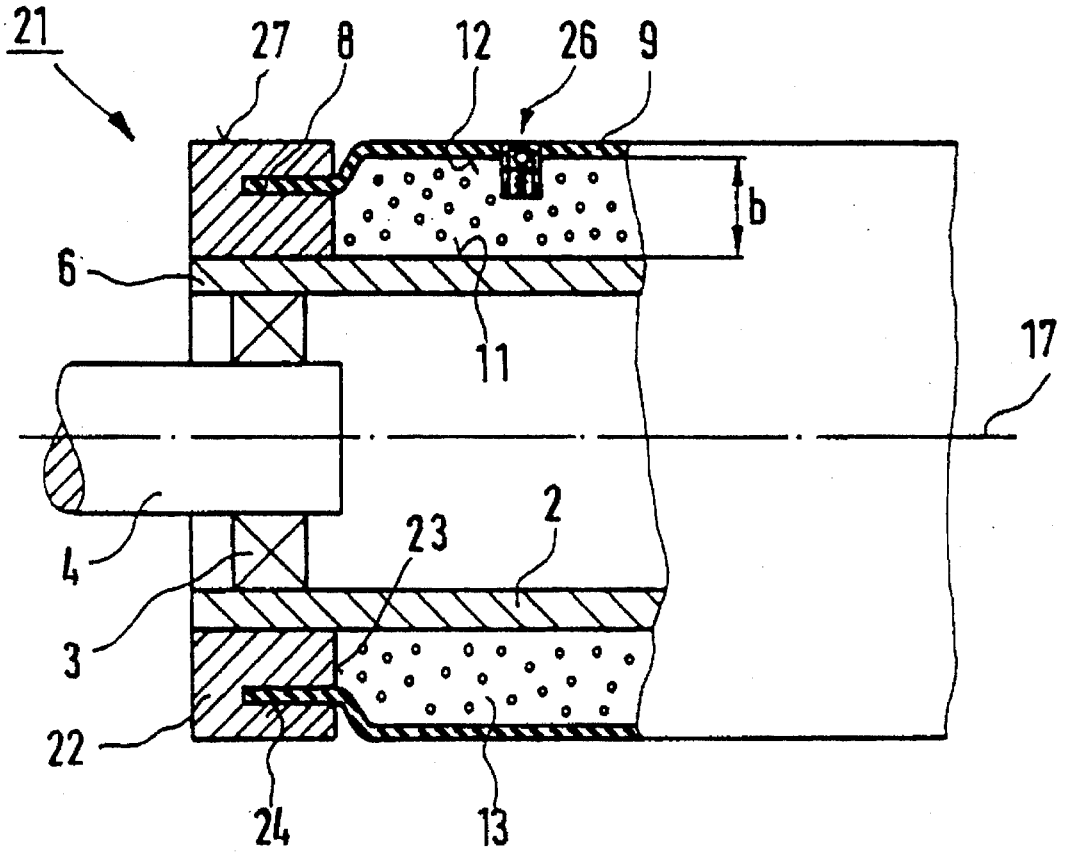
FIG. 4 is a side view, partly in cross-section of a second preferred embodiment of a press-on roller in accordance with the present invention.

Turning now to FIG. 4, there may be seen a second preferred embodiment, generally at 21, of a press-on roller in accordance with the present invention. In this and the other preferred embodiments, the same reference numbers are used to denote corresponding elements. Thus in the second preferred embodiment, press-on roller 21 includes a support tube 2 having ends 6 which are provided with ball bearing assemblies 3 that receive journals 4. Each end 6 of the support tube 2 is, in this second embodiment, provided with an annular flange 27 that is generally similar to the end caps 7 used in the first preferred embodiment 1. In this second embodiment 21, each annular flange or end cap 27 has a circular slot 24 on its inner face. This slot 24 receives an end 8 of the elastic press-on shell 9. There is again formed an annular hollow space 13 between the outer surface 11 of support tube 2 and the inner surface 12 of the press-on shell 9. This annular area is also defined by the annular flanges or end caps 27. In this second preferred embodiment, the annular space 13 is filled with a compressed gas, such as compressed air, which is added to the annular space 13 or exhausted from this space by use of a suitable valve 26 which can be located in the press-on shell 9, as depicted in FIG. 4, or which could be positioned in one of the annular flanges or end caps 27. The annular cell 13 can be filled with compressed air from any suitable source and the air pressure in the space 13 can be adjusted to provide the necessary resiliency to the press-on shell 9 of this second preferred embodiment 21 of the press-on roller in accordance with the present invention. It will be understood that the amount of flattening of the press-on roller 21 which will occur as it exerts a counter pressure against a paper web on a fresh web supply reel will be a function of the air pressure in the annular space 13. Instead of providing the annular flanges or end caps 22 with circular slots 24, the press-on shell 9 could be shrunk fit to an outer circumference 27 of each of the annular flanges 22.

Figure 5:
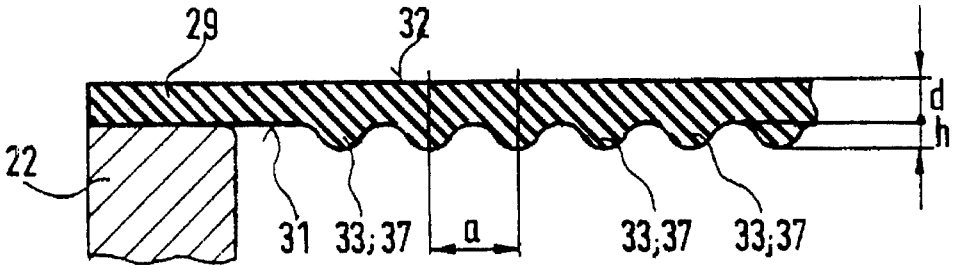
FIG. 5 is a cross-sectional view of a portion of a press-on roller and showing a first structure of the elastic press-on shell.
Figure 6:
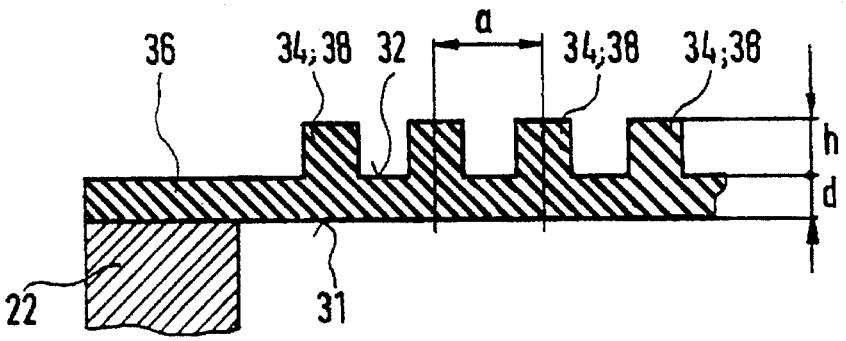
FIG. 6 is a view similar to FIG. 5 and showing a second structure of the elastic press-on shell.

The press-on shell 9 can be essentially smooth surfaced, both interiorly and exteriorly, as shown in FIGS. 1, 2, and 4. Alternatively, the press-on shell can be provided with either inner or outer surface projections or "naps" as is shown in FIGS. 5 and 6. As is shown specifically in FIG. 5, the press-on shell 29 can be formed having a smooth outer surface 32 and with an inner surface 31 having a plurality of individual, inwardly directed projections or naps 33 which are arranged generally in circumferential rings with each ring being spaced axially from adjacent rings by an axial spacing distance "a". Instead of a plurality of individual naps or projections 33 in each ring, there could be provided a plurality of axially spaced rings 37. In the press-on shell 29 shown in FIG. 5, these naps 33 or rings 37 are shown as being positioned on the inner surface 31 of the shell 29. In the press-on shell 36 shown in FIG. 6, the naps 34 or the rings 38 are depicted as being located on the outer surface 32 of the shell. It would be possible to locate naps 33 or 34 or rings 37 or 38 on both the inner 31 and outer 32 surfaces of the elastic press-on shell 29 or 36. These naps 33 and 34 can have a tapered, cone-like shape or a generally cylindrical shape. The circumferential rings 37 and 38 could also be rounded at their upper and lower edges so that their cross-sections would resemble cones or truncated cones, as depicted in FIG. 5. Alternatively, these rings could have generally sharp or right edges, as shown in FIG. 6. The height "h" of each of the naps 33 or 34, or of the rings 37 or 38 will correspond at least to a thickness "d" of the elastic press-on shell 29 or 36 of which they are a part.

In accordance with another aspect of the invention, which is not specifically depicted in the drawings the elastic press-on shell 36 could be provided with surface projections in the form of spikes of the elastic material, such as rubber, instead of the naps 33 or 34 depicted in FIGS. 5 and 6. These other surface projections could be situated on the outer surface 32 of the elastic press-on shell 36 and could be spaced apart from each other at a distance of about 0.25 times "a". These surface projections or spikes would have a height which would be greater than the height "h" of the naps 33 and 34 or of the rings 37 and 38 depicted in FIGS. 5 and 6. It would also be possible to provide the elastic press-on shell 9 with a wavy longitudinal section. The material used for the resilient, elastic press-on shells 9, 29 and 36 could be, for instance, rubber. All of the naps 33 or 34 or the rings 37 or 38, or the spikes discussed above will be formed as integral parts of the elastic press-on shells 9, 29 or 36.

Figure 7:
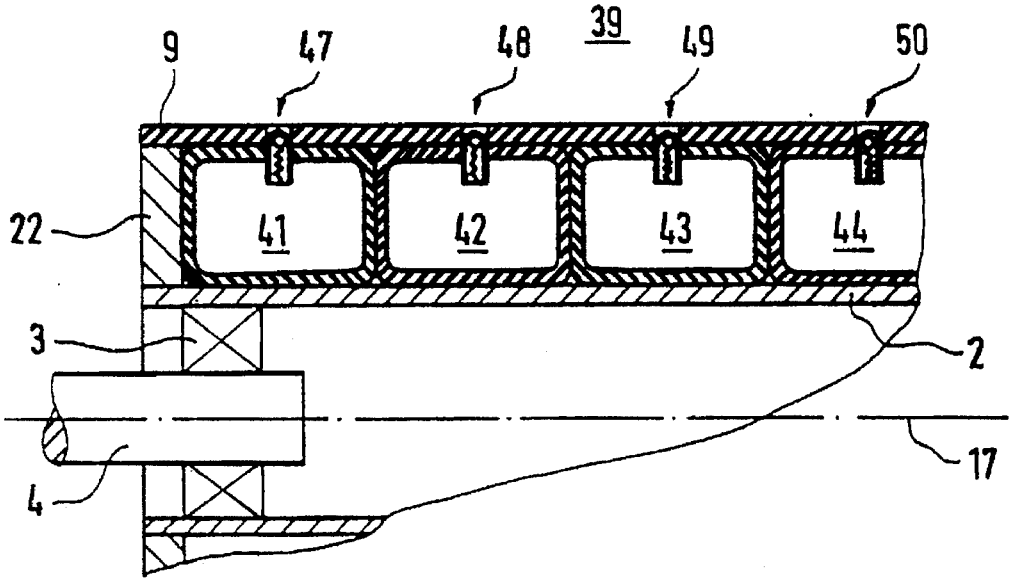
FIG. 7 is a side view, partly in cross-section of a third preferred embodiment of a press-on roller in accordance with the present invention.

Referring now to FIG. 7, there may be seen, generally at 39, a third preferred embodiment of a press-on roller in accordance with the present invention. In this third embodiment, the support tube 2 of the roller 39 carries a plurality of axially spaced, generally annular gas-filled cells 41, 42, 43, and 44. It will be understood that a sufficient number of these annular cells will be used to fill the space from one end flange 22 or end cap to the other similar end cap or end flange 22 and that the showing of four such annular cells is for purposes of illustration. Each cell is supported by the support tube 2 and the cells 41–44 are spaced adjacent each other along the axial length 17 of the support tube 2. Each of these annular cells 41–44 is provided with a valve 47–50, respectively, on its outer circumferential surface. These valves are accessible through the elastic press-on shell 9 which overlies the annular cells 41–44. By using these valves 47–50, the gas pressure in each cell can be individually adjusted. This allows the resiliency of the press-on roller 39 to be varied along the axial length 17 of the roller. As discussed previously, this will allow the press-on roller to deform or deflect to varying degrees along its length in accordance with different surface characteristics of the paper web supply reel which the press-on roller 39 will be caused to contact.

While preferred embodiments of a press-on roller in accordance with the present invention have been set forth fully and completely hereinabove, it will be apparent to one of skill in the art that a number of changes in, for example, the overall size of the roller, the structure of the roller support arms, the types of bearings used, and the like could be made without departing from the true spirit and scope of the present invention which is accordingly to be limited only by the following claims.

What is claimed is:

1. A press-on roller for pressing a first moving web of material to the beginning of a second moving web of material wound on a rotating web supply reel comprising:

a central support tube having spaced first and second ends and a longitudinally extending axis of rotation;

first and second annular end caps secured to said first and second ends of said central support tube;

an elastic hollow cylindrical press-on shell, said press-on shell being supported by said first and second end caps and extending coaxially to said support tube and having an active length corresponding to a width of a moving web of material;

an annular space defined by said central support tube, said press-on shell and said end caps; and at least one gas-filled cell in said annular space, said at least one gas-filled cell resiliently supporting said press-on shell spaced from said support tube.

2. The press-on roller of claim 1 wherein a plurality of said gas-filled cells are arranged on a flexible carrier material and further wherein said flexible carrier material is wrapped in several layers on said support tube.

3. The press-on roller of claim 2 wherein outer surfaces of a radially outer one of said several layers of said flexible carrier are part of said elastic press-on shell.

4. The press-on roller of claim 1 wherein a plurality of said cells are arranged one beside the other along said central support tube.

5. The press-on roller of claim 1 wherein there are a plurality of cells and further wherein each of said cells is closed.

6. The press-on roller of claim 1 wherein there are a plurality of cells and further wherein adjacent cells are interconnected.

7. The press-on roller of claim 1 further including a valve arranged in said press-on shell and in communication with said at least one gas-filled cell.

8. The press-on roller of claim 1 further including spaced naps on at least an inner or an outer surface of said elastic press-on shell.

9. The press-on roller of claim 8 wherein each of said naps is tapered in cross-section.

10. The press-on roller of claim 8 wherein each of said naps is cylindrical.

11. The press-on roller of claim 1 further including a plurality of axially spaced, circumferentially extending rings on at least an inner or an outer surface of said elastic press-on shell.

12. The press-on roller of claim 11 wherein each of said rings has rounded edges.

13. The press-on roller of claim 8 wherein a height of each of said naps is at least as great as a thickness of said press-on shell.

14. The press-on roller of claim 11 wherein a height of each of said rings is at least as great as a thickness of said press-on shell.

15. The press-on roller of claim 1 wherein said elastic press-on shell has a wavy form seen in said longitudinal direction.

16. The press-on roller of claim 4 wherein said plurality of cells are arranged beside each other along said longitudinally extending axis of rotation.

17. The press-on roller of claim 16 further including a valve connected to each of the cells and accessible through said elastic press-on shell.

18. A resilient press-on roller for pressing a depleting paper web into engagement with a surface of a new paper web on a fresh paper web supply reel, said press-on roller comprising:

a central support tube having spaced first and second ends, an outer surface and being rotatable about a longitudinally extending axis of rotation;

first and second end caps secured to said first and second ends of said central support tube;

a resilient press-on shell supported by said first and second end caps coaxially with, and spaced from said support tube;

an annular space defined by said outer surface of said support tube, said first and second end caps and said press-on shell; and a plurality of gas-filled cells situated in said annular space to resiliently support said press-on shell spaced from said central support tube.

19. The press-on roller of claim 18 further including valve means for said gas-filled cells, said valve means facilitating changing of a pressure of a gas in said gas filled cells.

* * * * *